US006081281A

United States Patent [19]

Cleary et al.

[11] Patent Number: 6,081,281

[45] **Date of Patent: *Jun. 27, 2000**

[54] SPRAY HEAD FOR A COMPUTER-CONTROLLED AUTOMATIC IMAGE REPRODUCTION SYSTEM

[75] Inventors: Arthur L. Cleary, Laconia; Peter L. Duffield, Meredith, both of N.H.

[73] Assignee: Vutek, Inc., Meredith, N.H.

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,067

[22] Filed: Mar. 19, 1997

Related U.S. Application Data

[63] Continuation of application No. 08/186,308, Jan. 26, 1994, abandoned, which is a continuation-in-part of application No. 07/814,566, Dec. 30, 1991, abandoned.

[51] Int. Cl.[7] ..... B41J 2/015

[52] U.S. Cl. ..... 347/21; 347/83; 239/270

[58] Field of Search ..... 347/3, 21, 83, 347/85–87, 103; 239/86, 87, 103, 270, 291, 345, 346, DIG. 14; D23/213; 118/21, 24, 46, 627, 628, 300; 427/42

[56] References Cited

U.S. PATENT DOCUMENTS

| | | | |
|---|---|---|---|
| 474,158 | 5/1892 | Burdick | 239/346 |
| 649,431 | 5/1900 | Burdick | 239/345 |
| 653,496 | 7/1900 | Wold | 239/345 |
| 767,510 | 8/1904 | Wold | 239/414 |
| 1,179,095 | 4/1916 | Hall | 239/143 |
| 1,268,403 | 6/1918 | Stacker | 239/345 |
| 1,272,752 | 7/1918 | Wold | 239/415 |
| 1,294,190 | 2/1919 | Sturcke | 239/415 |
| 1,299,290 | 4/1919 | Berg | 239/346 |
| 1,333,488 | 3/1920 | Hamaker et al. | 239/345 |
| 1,638,550 | 8/1927 | Paasche | 239/346 |
| 1,703,359 | 2/1929 | Paasche | 239/353 |
| 1,709,926 | 4/1929 | Weaver | 358/508 |
| 1,817,098 | 8/1931 | Ranger | 358/508 |
| 2,264,564 | 10/1941 | Connor | 239/346 |
| 2,550,404 | 4/1951 | Chasan et al. | 239/346 |

(List continued on next page.)

FOREIGN PATENT DOCUMENTS

| | | | |
|---|---|---|---|
| 56-89951 | 7/1981 | Japan . | |
| 1-108053 | 4/1989 | Japan . | |
| 3-184854 | 8/1991 | Japan | 347/21 |
| 5-185604 | 7/1993 | Japan . | |
| 5-185609 | 7/1993 | Japan . | |
| 6-122193 | 5/1994 | Japan . | |

OTHER PUBLICATIONS

Dollenmayer, "Ink Jet Nozzle Design," *IBM Technical Disclosure Bulletin*, 22(6):2333–2334, 1979.

Dollenmayer, W.L., "Ink Jet Nozzle Design", IBM Technical Discloure Bulletin, vol. 22 No. 6 Nov. 1979, pp. 2333–2334.

*Primary Examiner*—Benjamin R. Fuller
*Assistant Examiner*—Charlene Dickens
*Attorney, Agent, or Firm*—Fish & Richardson P.C.

[57] ABSTRACT

Reproducing a predetermined pattern on a medium, by for example, an apparatus that includes in combination a source of colored ink, a primary source of compressed air, a spray head including a housing having an inner ink chamber in flow communication with the source of ink, an outer air chamber in flow communication with the source of air and surrounding the inner ink chamber, a spray nozzle having an outside diameter and an internal longitudinal bore connected to the inner ink chamber and extending forward of the housing. A spray shield has an outer surface adjacent the medium and an inner surface positioned adjacent to and spaced from the housing and has a transverse opening therethrough in alignment with the nozzle. An auxiliary air supply has a pressure significantly less than the pressure of the air from the primary source of compressed air. The auxiliary air supply is in flow communication with the space between the shield and the housing thereby to force clean air through the space and out through the spray shield opening.

37 Claims, 4 Drawing Sheets

U.S. PATENT DOCUMENTS

| | | | |
|---|---|---|---|
| 2,721,763 | 10/1955 | Miner | 239/308 |
| 3,553,371 | 1/1971 | Suenaga | 358/502 |
| 4,020,990 | 5/1977 | Luff | 239/346 |
| 4,079,893 | 3/1978 | Bass | 239/346 |
| 4,102,500 | 7/1978 | Luff | 239/345 |
| 4,146,900 | 3/1979 | Arnold | 347/21 |
| 4,161,289 | 7/1979 | Rebold | 239/346 |
| 4,171,097 | 10/1979 | Rebold | 239/341 |
| 4,278,983 | 7/1981 | Halasz | 347/47 |
| 4,403,234 | 9/1983 | Miura et al. | 347/21 |
| 4,546,922 | 10/1985 | Thometz | 239/304 |
| 4,606,501 | 8/1986 | Bate et al. | 239/346 |
| 4,613,875 | 9/1986 | Le et al. | 347/21 |
| 4,620,198 | 10/1986 | Behun | 347/43 |
| 4,658,273 | 4/1987 | Yuki et al. | 347/86 |
| 4,742,963 | 5/1988 | Marvaldi | 239/337 |
| 4,914,522 | 4/1990 | Duffield et al. | 347/21 X |
| 4,999,651 | 3/1991 | Duffield et al. | 347/3 |
| 5,119,110 | 6/1992 | Arauchi et al. | 347/54 |

SPRAY HEAD FOR A COMPUTER-CONTROLLED AUTOMATIC IMAGE REPRODUCTION SYSTEM

CROSS REFERENCE TO RELATED APPLICATION

This is a continuation of application Ser. No. 08/186,308, filed Jan. 26, 1994, now abandoned; which is a continuation-in-part of application Ser. No. 07/814,566, filed Dec. 30, 1991 now abandoned.

BACKGROUND OF THE INVENTION

1. Field of the Invention

This invention relates to an ink jet spray head in which the ink spray is controlled by modulation of an air stream. More particularly it relates to such a spray head that forms part of a system for reproducing and enlarging color images under computer control.

2. Description of Related Art

U.S. Pat. Nos. 474,158; 653,496; 649,431; 1,272,752; 2,264,564; 1,638,550; 1,703,359; 1,299,290; 2,550,404; 2,721,763; 4,020,990; 4,079,893; 4,102,500; 4,161,289; 4,171,097; and 4,606,501 are typical of ink jet spray heads in which a flow of air across an ink meniscus atomizes and sprays ink upon the medium. The flow of ink is controlled by varying the quantity of air admitted to the spray head or by the position of a needle extending into the spray orifice or by other valve arrangements. U.S. Pat. No. 767, 510describes a similar spray head in which the control needle is stationary and the tube forming the orifice around the needle is moved to adjust the spray intensity. U.S. Pat. Nos. 1,179,095; 1,294,190; 1,333,488 describe spray heads in which the ink is fed by gravity or other independent pressure means into the spray orifice and compressed air is provided only to atomize the ink, not to withdraw it from the ink reservoir.

The foregoing patents describe systems in which, for the most part, the spray heads are hand operated. Various systems have been developed for automatically spraying enlarged color prints, such as for billboards, in which an original image is scanned to produce signals that operate the reproduction equipment. U.S. Pat. No. 1,709,926 describes a system in which three separate ink jets are controlled by data from an original image while the heads scan the medium being sprayed. U.S. Pat. No. 3,553,371 describes a multi-color imaging system in which the ink flow rate is controlled by changing the pressure of the air producing the atomization. The same patent also describes a spray head in which the ink flow is controlled by a mechanical flow valve operated from the input data signals. U.S. Pat. Nos. 4,914, 522 and 4,999,651 describe spray heads in which the flow of ink is controlled by pulse width modulation of air supplied to the spray head.

U.S. Pat. No. 4,403,234 to Miura et al. and U.S. Pat. No. 5,119,110 to Aruchi et al. disclose spray heads for depositing droplets of ink, but neither patent discloses any means for producing a transverse asymmetrical relationship between the flow of the air and the ink in the area of the exposed end of the spray nozzle.

SUMMARY OF THE INVENTION

When spray heads are used in automatic systems it is important that the spray characteristics of the head remain unchanged during the production of an entire image, which in the case of large reproductions, may extend over a period of several hours. Any change in the characteristics of a spray head may show up in the final reproduction as an error in color fidelity or in any of various forms of lining or mismatches. For example, if the atomized ink spray is allowed to collect around the ink jet of the spray head, the resulting change in either flow rate or pattern will cause aberrations in the reproduced image.

Other problems may arise from instability of the spray head. For example, a spray head may from time to time produce a blotched image arising from any of several causes. If a system in which the jet produces a spray that is symmetrically surrounded by a high speed air stream that atomizes the ink is disturbed by any slight variation in the system or the environment, it may become unstable with random lateral and radial motions of the jet stream that produce a blotched effect in the image.

The spray head embodying the present invention provides an air flow control system that minimizes the build-up of ink deposits on or adjacent the jet and which is intentionally constructed to provide an asymmetrical or unbalanced mode of spray operation resulting in significant reduction in blotching. An air baffle system accompanied with a low velocity flow of air minimizes ink build-up on the head.

DESCRIPTION OF THE PREFERRED EMBODIMENTS

The spray head described here is intended for use in a spray system of the general type described in U.S. Pat. No. 4,914,522 in which a number of spray heads scan successive lines across a flexible medium while the structure and color of the printed pattern is controlled by a computer mechanism. The quantity of ink sprayed on each pixel is controlled by pulse-width modulation in accordance with data from an original image. The spray head described here is generally similar in operation to that described in U.S. Pat. No. 4,999,651.

Figure 1:
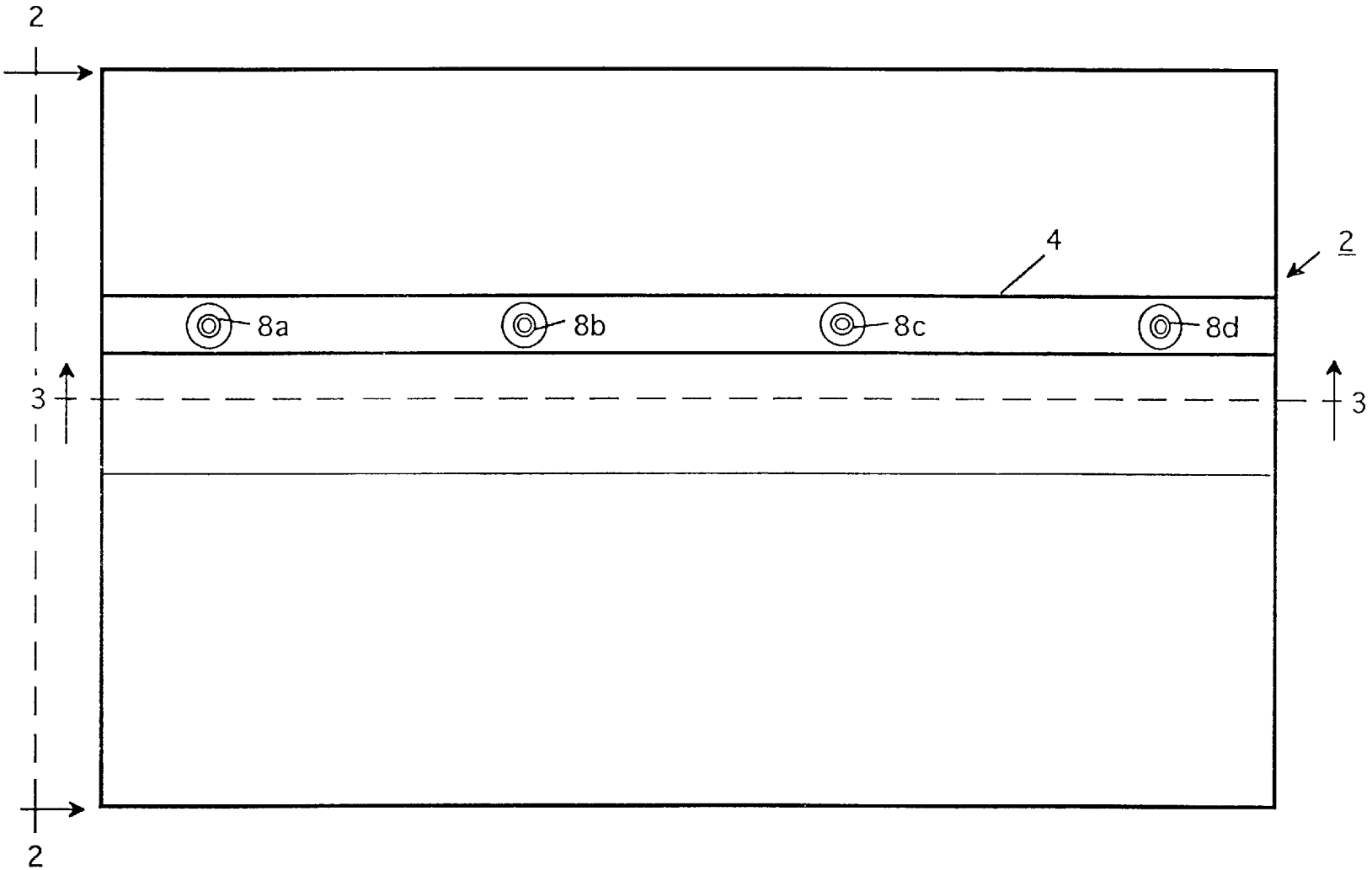
FIG. 1 is a diagrammatic perspective view of a spray head unit with four jet assemblies for different colored inks.
Figure 2:
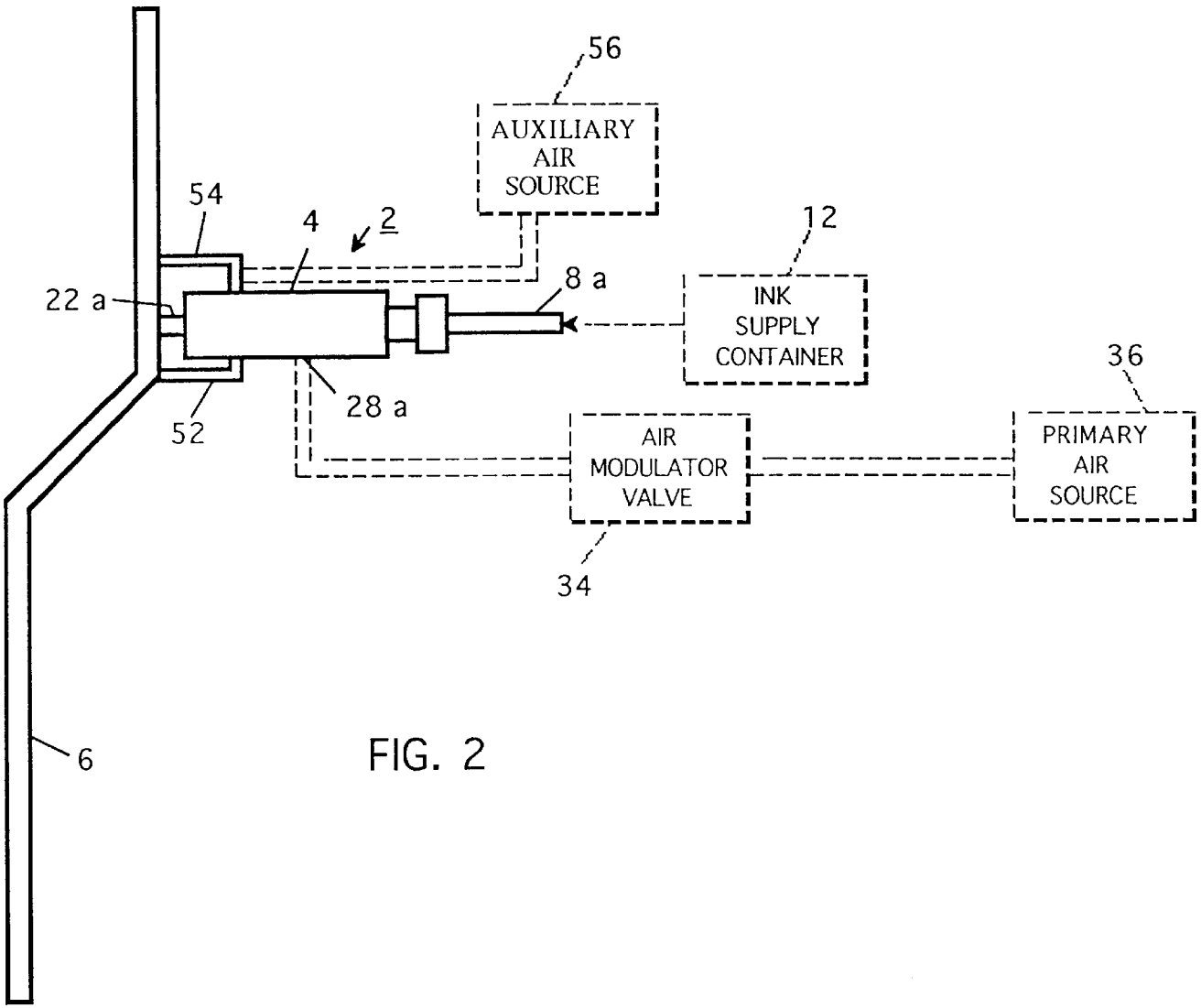
FIG. 2 is an end view of the spray head unit along line 2—2 of FIG. 1.
Figure 3:
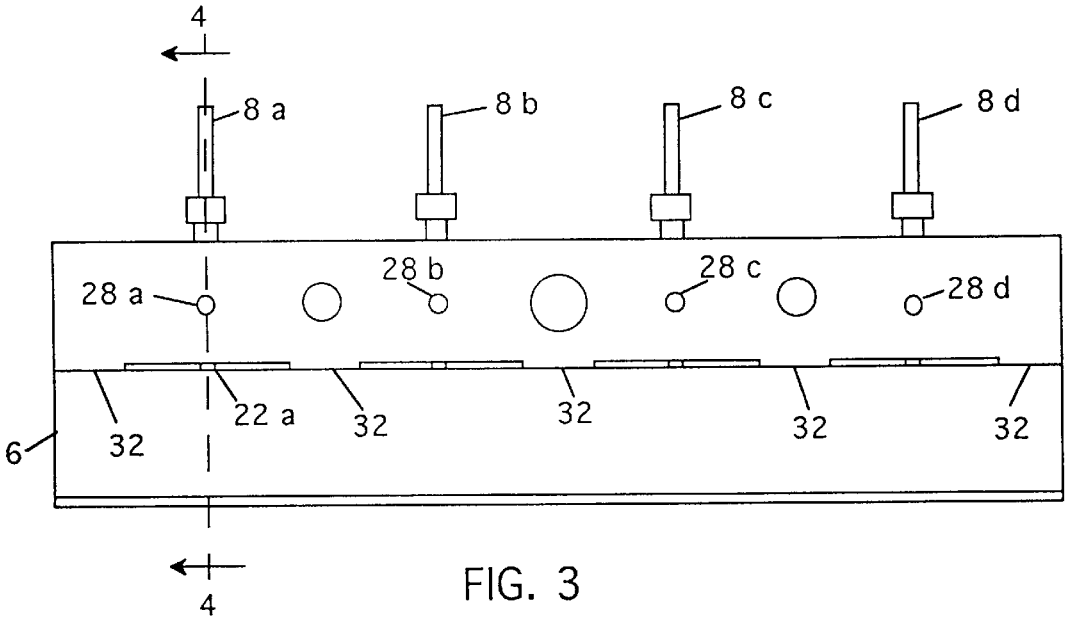
FIG. 3 is a bottom view along line 3—3 of FIG. 1.

As shown in FIGS. 1–3, a spray head, generally indicated at 2, includes a housing 4 secured to one side of a spray shield 6. The housing 4, which is typically about 2.5 inches long, 0.1875 inches thick and 0.5 inches wide, encompasses four jet assemblies each one similar to the jet assembly shown in the enlarged sectional view of FIG. 4. Four ink inlet connectors 8*a*, 8*b*, 8*c* and 8*d* are each connected to one of the jet assemblies and to an ink supply container, indicated diagrammatically at 12, in FIG. 1. Each of four chambers in the ink supply container 12 supplies one color of ink to the ink jet assembly to which it is connected.

Figure 4:
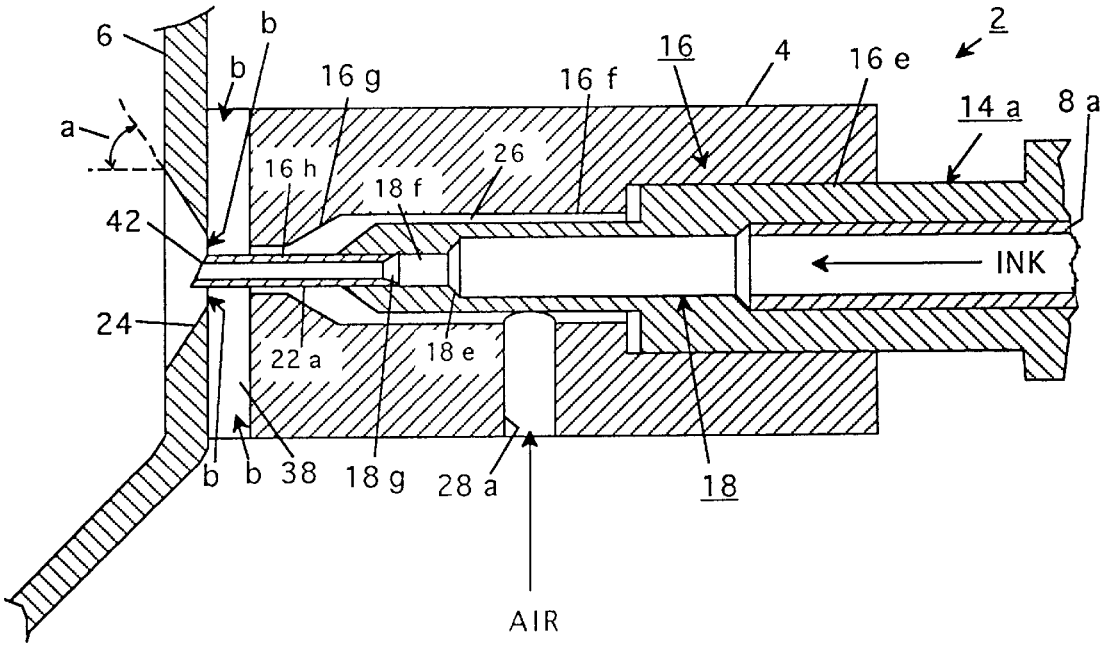
FIG. 4 is an enlarged sectional view along line 4—4 of FIG. 3 showing one of the jet assemblies of FIGS. 1–3.

FIG. 4 is a cross section through one of the four jet assemblies contained within the housing 4, which typically is formed of brass or other metal or plastic. The ink inlet connector tube 8*a* extends into a central bore in a nozzle control member, generally indicated at 14*a,* that is in turn press-fitted into the largest diameter portion 16*e* of a bore, generally indicated at 16, that extends crosswise through the housing 4. The larger bore section 16*e* is followed by a linear section 16*f* of reduced diameter, and a tapered section 16*g* where the diameter is gradually reduced to connect to a smaller linear nozzle bore section 16*h*.

The ink inlet connector 8*a* opens into a bore, generally indicated at 18, that extends through the nozzle control member 14*a*. The bore 18 is tapered as indicated at 18*e* to form a smaller linear section 18*f*. The diameter of the bore 18 is further reduced at 18*g* and connected to a nozzle 22*a* that extends through the bore section 16*h* and beyond the forward surface of the housing 4 into an opening 24 in the spray shield 6.

Ink flows into the housing 4 through the ink inlet connector 8*a* into the bore 18 and from there into the nozzle 22. The annular space 26 formed between the outer surface of the nozzle control member 14*a* and the bore 16 forms a passageway for the flow of air that enters the housing thorough an opening 28*a*.

The nozzle 22*a* extends forward from the housing 4 into an opening 24 in the spray shield 6 that is spaced from the adjacent surface of the housing 4. The opening 24 through the shield 6 is tapered with its smaller end surrounding and spaced from the end portion of the nozzle 22*a*. The surface of the tapered wall of the opening 24 forms an angle, indicated at "a", preferably between 30 and 60 degrees, from the longitudinal axis of the nozzle 22*a*. The thickness of the spray shield 6 is preferably between 0.02 and 0.20 inches and the end of the nozzle 22*a* is positioned horizontally between the two surfaces of the shield. The small end of the tapered opening 24 adjacent the housing 4 is about 0.05 inches and preferably between 0.03 and 0.08 inches. Typically, the smallest diameter of the opening 24 is about twice the outside diameter of the nozzle 22*a*. The largest diameter of the tapered opening 24 is about 0.14 inches.

As indicated diagrammatically in FIG. 2, the air inlet 28*a* is connected through a modulator valve 34 to a source 36 of high pressure air. In operation, air is supplied under high pressure from the source 36 through the modulator valve 34 and into the annular passageway 26 and then through the tapered section to the smaller annular passageway 16*h* around the nozzle 22*a*. At this point, the air is traveling at very high velocity and upon leaving the housing 4 forms an unconfined tubular sonic jet around the nozzle 22*a*. The sonic velocity of the air stream renders its velocity relatively independent of small changes in air pressure. Colored ink is supplied from the container 12 (FIG. 2) that is connected through the central opening 18 (FIG. 3) to the nozzle 22*a*. When the air passes at high velocity around the end of the nozzle 22*a,* it creates a suction that draws ink from the source 12 and atomizes it through the opening 24. As used here and in the claims, the term "ink" refers to either pigmented or non-pigmented colored ink or paint.

The valve 34 is operated to control the flow of air that in turn regulates the flow of ink to produce the desired pattern. As mentioned above, U.S. Pat. Nos. 4,914,522 and 4,999,651 describe a suitable modulation system.

The plane inner surface of the shield 6 is parallel with the adjacent planar surface of the housing 4 and is spaced from it a distance preferably between 0.02 and 0.05 inches. In the embodiment illustrated in FIG. 4, the space 38 between the housing 4 and the shield 6 is open to the surrounding atmosphere. The flow of high-velocity air around the nozzle 22*a* creates a suction that draws clean air at a low velocity through the space 38 and into the opening 24 of the shield 6, as indicated by the arrows "b". This auxiliary air flow reduces the ink build-up around the nozzle 22*a* that would otherwise detract from the reproduction fidelity of the system.

The end portion of the nozzle 22*a* is asymmetric with respect to the high-velocity air flow. In this example, the asymmetry is achieved by forming the nozzle with an end surface 42 extending at an angle to the longitudinal axis of the nozzle. Preferably, the end surface 42 of the nozzle 22*a* forms an angle between 20 and 70 degrees from the longitudinal axis of the nozzle. In a typical system, the nozzle 22*a* has an outside diameter between 0.01 and 0.03 inches and the central capillary of the nozzle at the exit point from the housing 4 has a diameter between 0.005 and 0.015 inches.

The illustrated embodiment of the spray head has a number of advantages over more conventional approaches. The shield with its tapered opening surrounding the end of the nozzle 22*a* in cooperation with the low-velocity clean air flow through the space 38 inhibits the build-up of ink around the nozzle and adds to the long term stability of the system.

It is important that the nozzle release be asymmetrical with respect to the air flow. In a system in which the ink supply nozzle is symmetrical with respect to the surrounding air flow, the system will function satisfactorily under most operating conditions. However, when some circumstance momentarily upsets the equilibrium of the system, the ink meniscus on the end of the nozzle 22*a* may be deflected radially producing an asymmetry in the flow of the surrounding air. This distortion of the air stream lines causes the ink to move again and wet a different spot on the end of the nozzle 22*a*. This oscillation, accompanied by the back and forth motion of the ink meniscus, produces undesired blotching in the image. In this example, the end of the nozzle is formed at an angle that is non-perpendicular with respect to the direction of air flow around the nozzle. This causes a permanent radial deflection of the ink flow to a stable non-symmetrical direction.

Figure 5:
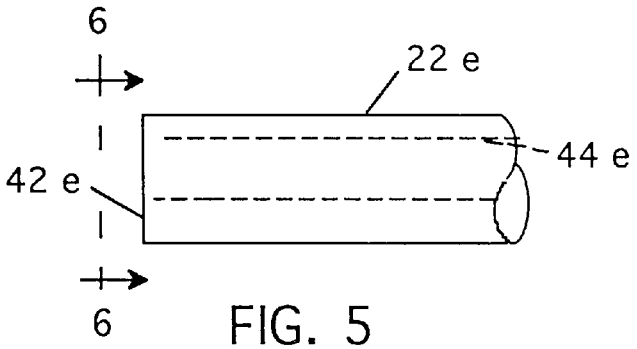
FIG. 5 is a side view of the end portion of a spray nozzle having an off-center capillary bore.
Figure 6:
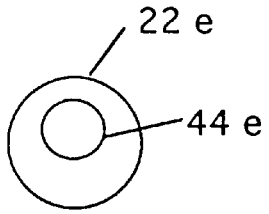
FIG. 6 is an end view along line 6—6 of FIG. 5.

The unsymmetrical relation of the nozzle with respect to the air flow can be achieved in a number of ways. For example, instead of forming the face of the nozzle at an angle with respect to a plane perpendicular to the air flow, the capillary opening may be positioned off-center with respect to the outer circumference of the nozzle. FIGS. 5 and 6 show the end portion of a nozzle 22*e* having a capillary bore 44*e* that is radially offset from the center longitudinal axis of the nozzle 22*e*. The flow of the ink is therefore distributed non-symmetrically with respect to the air flow.

Figure 7:
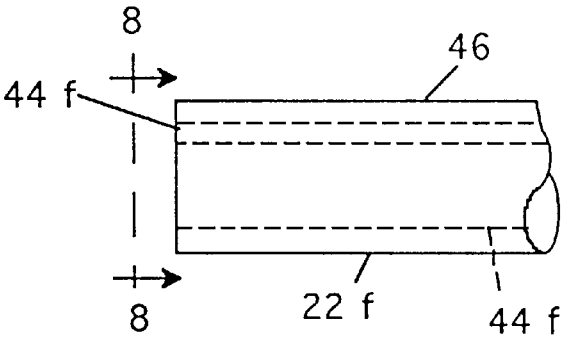
FIG. 7 is a side view of the end portion of a spray nozzle having a non-symmetrical external flange.
Figure 8:
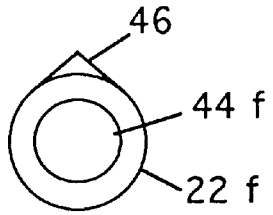
FIG. 8 is an end view along line 8—8 of FIG. 7.

FIGS. 7 and 8 illustrate another embodiment in which the nozzle 22*f* has a central capillary bore 44*f*. The outer surface of the nozzle for the most part has a circular cross section, but a flange or longitudinal protrusion 46 is formed along one side of the outer surface of the nozzle 22*f*. In this case, the ink flow is symmetrical with respect to the nozzle, but the non-symmetry between the ink flow and the air flow is introduced by altering the path of the air flow.

Figure 9:
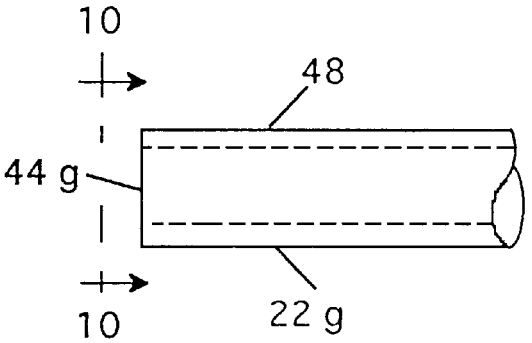
FIG. 9 is a side view of the end portion of a spray nozzle having a flattened external surface.
Figure 10:
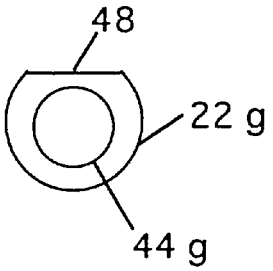
FIG. 10 is an end view along line 10—10 of FIG. 9.

FIGS. 9 and 10 illustrate a nozzle 22*g* having one flattened side 48. The wall thickness of the nozzle is substantially constant, but the flattened outer surface 48 produces a non-symmetrical flow of air. In each of the three embodiments illustrated in FIGS. 5–10, the end surfaces 44*e,* 44*f* and 44*g* of the nozzles may be perpendicular to the longitudinal axis of the nozzle. Other means may be provided for producing a non-symmetrical distribution of the ink with respect to the flow of the high-velocity air stream, but the expedient of forming the end of the nozzle 22*a* at an angle, as illustrated in FIG. 4, is preferred as being both simple and effective.

A further improvement in performance of the spray head may be achieved by providing a flow of low pressure clean air into the space between the shield 6 and the face of the housing 4. As illustrated by FIG. 2, a lower shroud portion 52 extending between the bottom of the housing 4 and the shield 6 encloses the space under the housing 4 and between the housing and the shield. An upper shroud portion 54 extending between the upper surface of the housing 4 and the shield 6 encloses the area above the housing 4. Appropriate end closures, not shown, are provided for both shroud portions so that the two shrouds in combination with the housing 4 and the shield 6 form a confined space. The interior of the upper shroud portion 54 is connected to an auxiliary source of air, diagrammatically indicated at 56 in FIG. 2, that supplies clean air at a constant pressure between about 2 and 6 psi, but in any event of a pressure insufficient to cause ink to flow from the nozzle 22*a*. The air source 56 may, for example, comprise a small electric fan carried by the same mechanism that supports the spray head assembly, or it may be a stationary source connected by flexible tubing to the shroud 54. Another alternative is to provide the low pressure air from the primary air source 36 through a conventional pressure reduction valve (not shown).

We claim:

1. Apparatus for reproducing a predetermined pattern on a medium comprising in combination a source of colored ink, a primary source of compressed air, and a spray head, said spray head comprising:

a housing having an inner ink chamber in flow communication with said source of ink, an outer air chamber in flow communication with said source of air and surrounding said inner ink chamber, a spray nozzle having an outside diameter and an internal longitudinal bore connected to said inner ink chamber and extending forward of said housing, a spray shield having an outer surface adjacent said medium and an inner surface positioned adjacent to and spaced from said housing and having a transverse opening therethrough in alignment with said nozzle, and an auxiliary air supply having a pressure significantly less than the pressure of the air from said primary source of compressed air, said auxiliary air supply being in flow communication with the space between said shield and said housing thereby to force clean air through the space and out through said spray shield opening.

2. A combination as claimed in claim 1 wherein said inner surface is spaced from said housing between about 0.02 and 0.05 inches.

3. The combination as claimed in claim 1 wherein said nozzle extends into said opening.

4. The combination as claimed in claim 3 wherein said nozzle terminates within said opening and between said inner and outer surfaces of said spray shield.

5. The combination as claimed in claim 2 wherein said opening in the spray shield is tapered through a thickness of the spray shield with a large diameter portion of the tapered opening positioned adjacent the medium to be sprayed, and said nozzle extends into said opening.

6. The combination as claimed in claim 4 wherein said opening in the spray shield is tapered from a portion having a large diameter to a portion having a smaller diameter with said smaller diameter surrounding said nozzle.

7. The combination as claimed in claim 6 wherein said portion of said tapered opening has a diameter approximately equal to twice the outside diameter of said nozzle.

8. The combination as claimed in claim 6 wherein said smaller portion in said spray shield is between about 0.03 and 0.08 inches.

9. The combination as claimed in claim 1 wherein said auxiliary air supply supplies air at a pressure of about 3 to 6 psi.

10. Apparatus for reproducing a predetermined pattern on a medium comprising in combination a source of colored ink, a primary source of compressed air, and a spray head, said spray head comprising:

a housing having an inner ink chamber in flow communication with said source of ink, an outer air chamber in flow communication with said source of air and surrounding said inner ink chamber, a spray nozzle having an outside diameter and an internal longitudinal bore connected to said inner ink chamber and extending forward of said housing, a spray shield having an outer surface adjacent said medium and an inner surface positioned adjacent to and spaced from said housing and having a transverse opening therethrough in alignment with said nozzle, and said nozzle has a longitudinal axis extending lengthwise of said nozzle and an end surface forming an angle significantly less than ninety degrees from the longitudinal axis of said nozzle.

11. The combination as claimed in claim 10 wherein said angle is between 20 and 70 degrees.

12. The combination as claimed in claim 10 including means for supplying air to the space between said housing and the spray shield at a pressure lower than the pressure supplied by said primary source of compressed air.

13. The combination as claimed in claim 12 wherein the pressure of said air supplied to the space between the spray shield and the housing is about 3 to 6 psi.

14. A jet spray system, comprising:

a medium to be sprayed with ink, an ink jet nozzle having a longitudinal axis extending lengthwise thereof and an exposed end portion adjacent said medium, said end portion of said nozzle having a non-circular external perimeter that is unsymmetrical with respect to the longitudinal axis of said nozzle, a source of ink connected to said nozzle, a primary source of high pressure air, means for directing a flow of air from said primary source around the end portion of said nozzle thereby to cause a flow of ink to be withdrawn from said nozzle and atomized upon said medium, and means for producing a transverse asymmetrical relationship between the flow of said air and said flow of ink adjacent said exposed end portion of said nozzle.

15. The system as claimed in claim 14 wherein the unsymmetry of said end portion of said nozzle is produced by an external projection on the nozzle.

16. A jet spray system, comprising a medium to be sprayed with ink, an ink jet nozzle having an exposed end portion adjacent said medium, said nozzle having an external circumference that deviates from a circular pattern by having a different radius of curvature over a portion of the circumference, a source of ink connected to said nozzle, a primary source of high pressure air, means for directing a flow of air from said primary source around the end portion of said nozzle thereby to cause a flow of ink to be withdrawn from said nozzle and atomized upon said medium, and means for producing a transverse asymmetrical relationship between the flow of said air and said flow of ink adjacent said exposed end portion of said nozzle.

17. A jet spray system, comprising a medium to be sprayed with ink, an ink jet nozzle having an exposed end portion adjacent said medium, a source of ink connected to said nozzle, a primary source of high pressure air, a spray shield having an outer surface adjacent said medium and having a transverse opening therethrough in alignment with said nozzle, means for directing a flow of air from said primary source around the end portion of said nozzle thereby to cause a flow of ink to be withdrawn from said nozzle and atomized upon said medium, and means for producing a transverse asymmetrical relationship between the flow of said air and said flow of ink adjacent said exposed end portion of said nozzle.

18. The system as claimed in claim 17 wherein said opening is tapered through a thickness of the spray shield with a large diameter portion nearest said medium.

19. The system as claimed in claim 17 wherein the end portion projects into said shield and terminates between opposing surfaces thereof.

20. The system as claimed in claim 17 wherein said nozzle has a longitudinal axis extending lengthwise of thereof and an end surface of said nozzle lies in a plane perpendicular to the longitudinal axis of the end portion of said nozzle.

21. The system as claimed in claim 20 wherein the end surface of said nozzle and the longitudinal axis of the end portion of the nozzle are disposed of an angle between about 20 and 70 degrees.

22. The system as claimed in claim 17 including means for supplying air to between said housing and the spray shield at a pressure lower than the pressure supplied by said primary source of compressed air.

23. A method of spray painting a predetermined pattern on a medium by atomized ink comprising the steps of providing an ink source, a nozzle having an open end with a capillary bore therein connected to said ink source, a primary source of compressed air, and means connecting said source of compressed air to said open end of said nozzle, positioning said nozzle with said open end adjacent said medium, forming a tubular flow of said air around said nozzle in a direction of said medium with sufficient velocity to withdraw ink from said nozzle, and providing a non-symmetrical mechanical structure adjacent said open end of said nozzle by positioning said capillary bore in said nozzle off-center from a central longitudinal axis of said nozzle, thereby creating a transverse asymmetrical relationship between the flow of said air and said ink adjacent said open end of said nozzle.

24. A method of spray painting a predetermined pattern on a medium by atomized ink comprising the steps of providing an ink source, a nozzle having an open end with a capillary bore therein connected to said ink source, and a primary source of compressed air connected to said open end of said nozzle, positioning said nozzle with said open end adjacent said medium, forming a tubular flow of said air around said nozzle in a direction of said medium with sufficient velocity to withdraw ink from said nozzle, and providing said nozzle with a cross-sectional non-circular exterior diameter that is unsymmetrical with respect to a central longitudinal axis of said nozzle, thereby creating a transverse asymmetrical relationship between the flow of said air and said ink adjacent said open end of said nozzle.

25. A method of spray painting a predetermined pattern on a medium by atomized ink comprising the steps of providing an ink source, a nozzle having an open end with a capillary bore therein connected to said ink source, and a primary source of compressed air connected to said open end of said nozzle, positioning said nozzle with said open end adjacent said medium, forming a tubular flow of said air around said nozzle in a direction of said medium with sufficient velocity to withdraw ink from said nozzle, and providing said open end of said nozzle with an external circumference that deviates from a circular pattern by having different radius of curvature over a portion of the circumference, thereby creating a transverse asymmetrical relationship between the flow of said air and said ink in the area of said open end of said nozzle.

26. A method of spray painting a predetermined pattern on a medium by atomized ink comprising the steps of providing an ink source, a nozzle having an open end with a capillary bore therein connected to said ink source, and a primary source of compressed air in flow communication with said open end of said nozzle, positioning said nozzle with said open end adjacent said medium, forming a tubular flow of said air around said nozzle in a direction of said medium with sufficient velocity to withdraw ink from said nozzle, providing a spray shield between said nozzle and said medium, said spray shield having a transverse opening therein in alignment with said nozzle, and providing a non-symmetrical mechanical structure adjacent said open end of said nozzle, thereby creating a transverse asymmetrical relationship between the flow of said air and said ink adjacent said open end of said nozzle.

27. The method as claimed in claim 26 wherein said opening in said spray shield is tapered through a thickness of the spray shield with a large diameter portion nearest said medium.

28. The method as claimed in claim 27 wherein a small diameter portion of said opening is approximately twice an outside diameter of said nozzle.

29. The method as claimed in claim 26 including the steps of producing an auxiliary flow of clean air at a pressure significantly less than the pressure provided by said primary air source and directing said air over a surface of said spray shield opposite from said medium and through said opening.

30. A system for spray painting a multi-colored pattern on a medium comprising in combination a primary source of compressed air, a plurality of ink sources for different colored inks, and a spray head, said spray head comprising; a plurality of jet spray assemblies each including a housing having an inner ink chamber, means for connecting inner ink chamber with one of said ink sources, an outer air chamber surrounding said inner ink chamber, means for connecting said air chamber to said primary source of air, and a spray nozzle having an internal capillary bore connected to said inner ink chamber and extending forward of said housing, and a spray shield positioned between said medium and said spray head, said shield having a plurality of transverse openings each including a spray nozzle extending therein.

31. The combination as claimed in claim 30 wherein each of said openings is tapered through a thickness of the spray shield with a large diameter portion of each of said openings positioned adjacent said medium.

32. The combination as claimed in claim 31 wherein each of said nozzles terminates within one of said openings.

33. The combination as claimed in claim 31 wherein a small diameter portion of each of said openings is about twice an outside diameter of an adjacent nozzle.

34. The combination as claimed in claim 32 including said housing enclosing said jet spray assemblies and having a surface spaced from said shield.

35. The combination as claimed in claim 34 including means for producing a low pressure auxiliary flow of clean air into said space between said housing and said shield and thence through said openings.

36. The combination as claimed in claim 35 wherein said auxiliary flow of clean air is at a positive pressure lower than the pressure required to extract ink from said nozzles.

37. The combination as claimed in claim 34 including means in combination with said shield and said housing for forming an enclosure encompassing an entrance to said space between said housing and said shield, and a source of low pressure air connected to said enclosure whereby a constant flow of air passes into said space between said housing and said shield and exits through said openings.

* * * * *